US006447329B1

(12) United States Patent
Yang

(10) Patent No.: US 6,447,329 B1
(45) Date of Patent: Sep. 10, 2002

(54) CONNECTOR

(75) Inventor: Rick Yang, Shinjuang (TW)

(73) Assignee: All Best Electronics Co., Ltd., Taipei (TW)

( * ) Notice: Subject to any disclaimer, the term of this patent is extended or adjusted under 35 U.S.C. 154(b) by 0 days.

(21) Appl. No.: 09/981,705

(22) Filed: Oct. 19, 2001

(51) Int. Cl.[7] ..... H01R 12/24
(52) U.S. Cl. ..... 439/492; 439/874
(58) Field of Search ..... 439/492, 499, 439/67, 77, 456, 459, 874

(56) References Cited

U.S. PATENT DOCUMENTS 4,973,264 A * 11/1990 Kamono et al. ..... 439/874
6,033,238 A * 3/2000 Fogg et al. ..... 439/492

* cited by examiner

*Primary Examiner*—Gary F. Paumen
(74) *Attorney, Agent, or Firm*—Bacon & Thomas, PLLC

(57) ABSTRACT

A connector includes an insulated base having a plurality of conductive terminals inserted onto a top thereof, and an insulated cover being structured to firmly hold a flat cable to the base. The base is provided at the top with a row of spacers to form a plurality of parallelly spaced slots, into which the conductive terminals are separately seated to partially expose from the top of the base. The flat cable is stripped at a predetermined section to expose a length of naked cores that are separately located in the spaced slots above the conductive terminals and are welded to the latter to provide increased contact areas between the terminals and the flat cable to ensure stable signal transmission at high speed. The spacers prevent the occurrence of short circuit during welding of the terminals to the naked cores of the flat cable.

3 Claims, 7 Drawing Sheets

CONNECTOR

BACKGROUND OF THE INVENTION

The present invention relates to a connector, and more particularly to a connector that includes spacers to prevent short circuit during welding of terminals on the connector to cores of a flat cable and provides increased contact areas between the welded terminals and cores of the flat cable to ensure stable signal transmission at high speed without causing signal fluctuation.

With the increasing development of computer-related technologies, the currently available computers all have a central processing unit (CPU) with almost incredibly powerful digital operation function. Under this condition, all other peripherals, including driving and driven components thereof, must be structured to match with the high processing speed of the CPU. A flat cable, which is located between the CPU and the driving and driven peripherals to transmit signals, therefore plays a very important role in the signal transmission, and connectors provided at two ends of the flat cable have direct influence on the successful signal transmission.

FIG. 1 is an exploded perspective view of a conventional connector 1 for use with a flat cable 2. The connector 1 mainly includes an electrically insulated base 11 and an electrically insulated cover 12 structured to firmly hold the flat cable 2 to the base 11. The base 11 is provided at a top with several rows of staggered piercing terminals 13. Each of the piercing terminals 13 includes piercing prongs 131 formed at a top thereof. When the flat cable 2 is firmly held between the base 11 and the cover 12, the piercing prongs 131 pierce through a skin 21 of the flat cable 2, as shown in FIGS. 2 and 3, to electrically connect cores 22 of the flat cable 2 to the terminals 13. It is noted that the piercing prongs 131 are in point contact or line contact with the cores 22 to transmit signals. Since the flat cable 2 has very closely arranged cores 22, it is possible the prongs 131 do not accurately pierce the flat cable 2 at the skin 21 or the prongs 131 pierce through the cores 22 to break the same, resulting in poor signal transmission. Moreover, the point contact or line contact between the prongs 131 of the piercing terminals 13 and the cores 22 of the flat cable 2 is too feeble to ensure good signal transmission via the flat cable 2 and the connectors 1 provided at two ends of the flat cable 2. Lowered transmission efficiency and unstable signals might occur.

It is therefore tried by the inventor to develop an improved connector that includes spacers to prevent short circuit during welding of terminals on the connector to cores of a flat cable and provides increased contact areas between the welded terminals and cores of the flat cable to ensure stable signal transmission at high speed without causing signal fluctuation.

SUMMARY OF THE INVENTION

A primary object of the present invention is to provide a connector that is able to prevent short circuit during connection of terminals on the connector to cores of a flat cable.

Another object of the present invention is to provide a connector that provides increased contact areas between terminals on the connector and cores of the flat cable to ensure stable signal transmission at high speed without causing signal fluctuation.

To achieve the above and other objects, the connector of the present invention mainly includes an electrically insulated base having a plurality of conductive terminals in the shape of an inverted letter "L" inserted onto a top thereof, and an electrically insulated cover being structured to firmly hold a flat cable to the insulated base. The insulated base is provided at the top with a row of spacers to form a plurality of parallelly spaced slots, into which horizontal contact parts of the conductive terminals are separately seated to partially expose from the top of the insulated base. The insulated base is also provided at two longitudinal sides of the row of spacers with two rows of staggered terminal holes corresponding to the spaced slots. The conductive terminals are sequentially seated in the spaced slots with vertical insertion parts thereof alternately inserted into the two rows of terminal holes. And, the flat cable is stripped at a predetermined section to expose a length of naked cores that are separately located in the spaced slots above the conductive terminals and are welded to the latter to provide increased contact areas between them. The increased contact areas between the terminals and the naked cores ensure stable signal transmission via the flat cable at high speed without causing signal fluctuation, and the spacers prevent the occurrence of short circuit during welding of the terminals to the naked cores of the flat cable.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
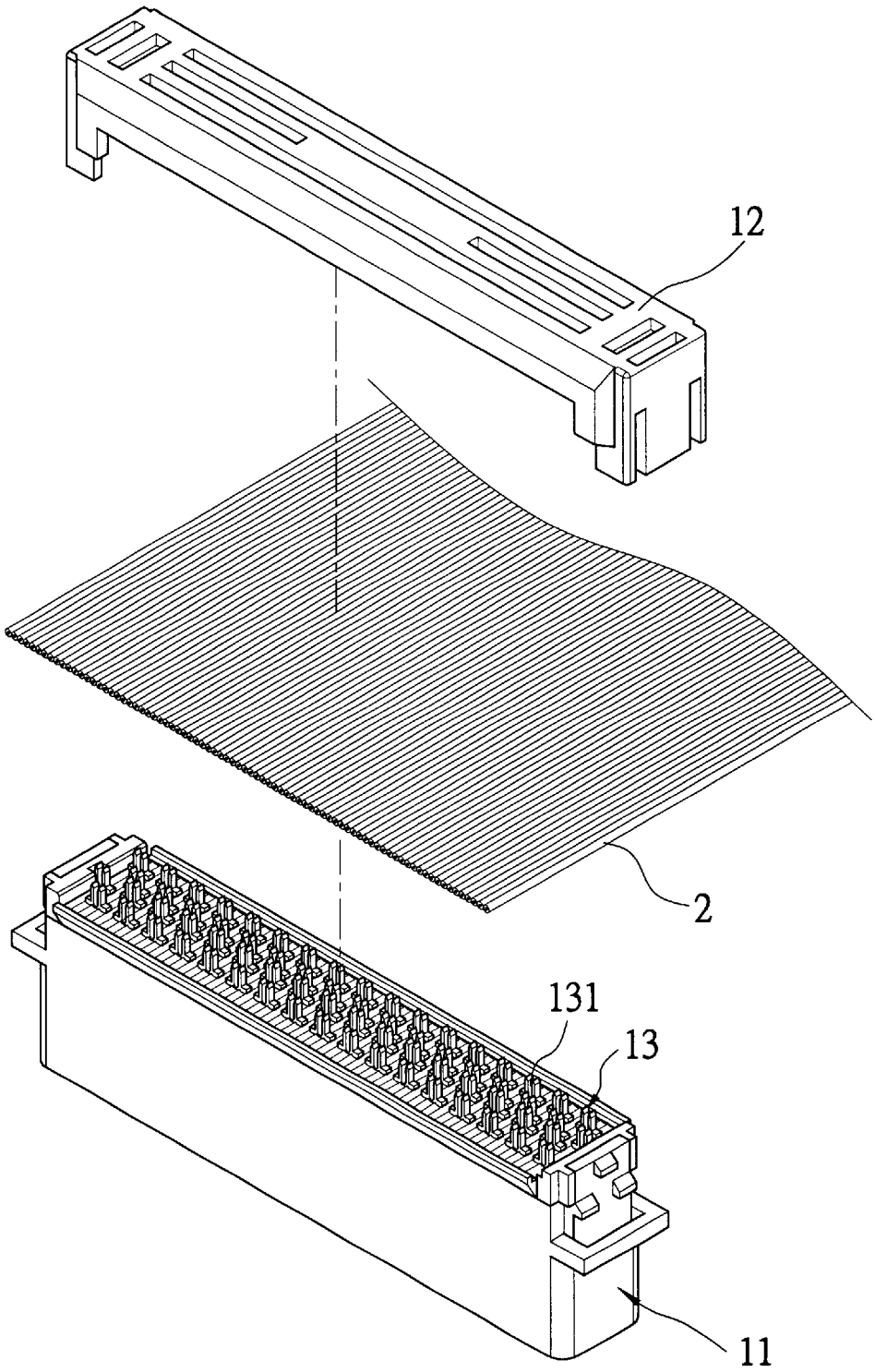
(PRIOR ART) Fig.1
FIG. 1 is an exploded perspective view of a conventional connector.
Figure 2:
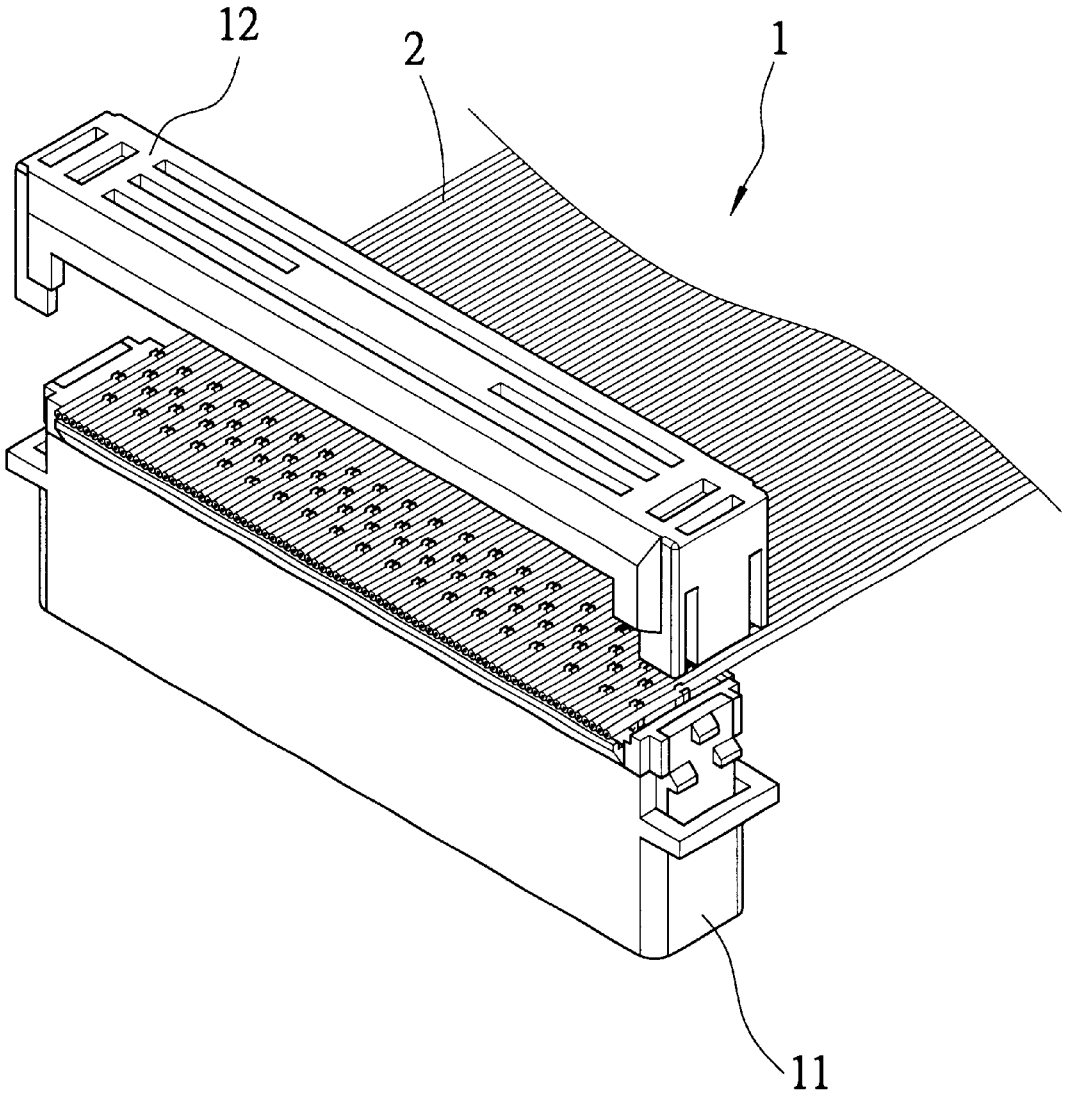
(PRIOR ART) Fig.2
FIG. 2 is a partially assembled perspective view of the conventional connector of FIG. 1.
Figure 3:
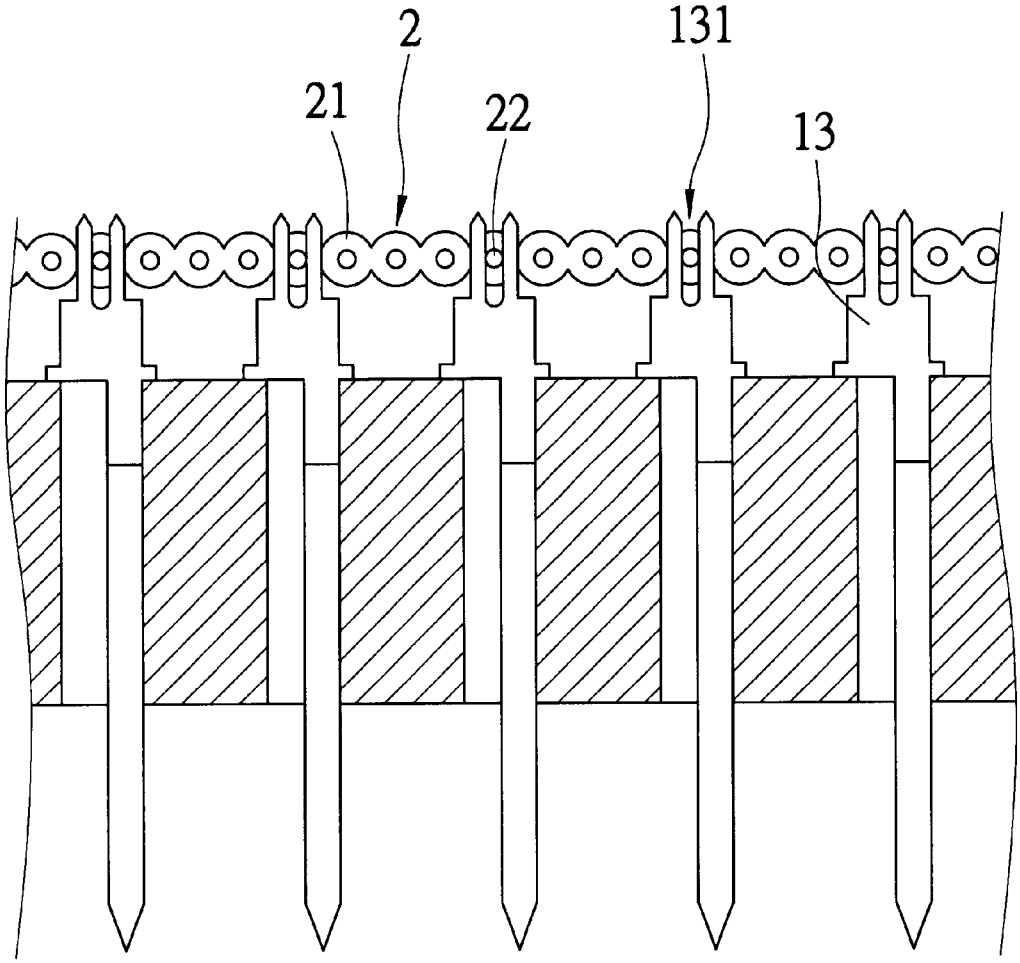
(PRIOR ART) Fig.3
FIG. 3 is a fragmentary and enlarged sectional view showing the partially assembled conventional connector of FIG. 1.
Figure 4:
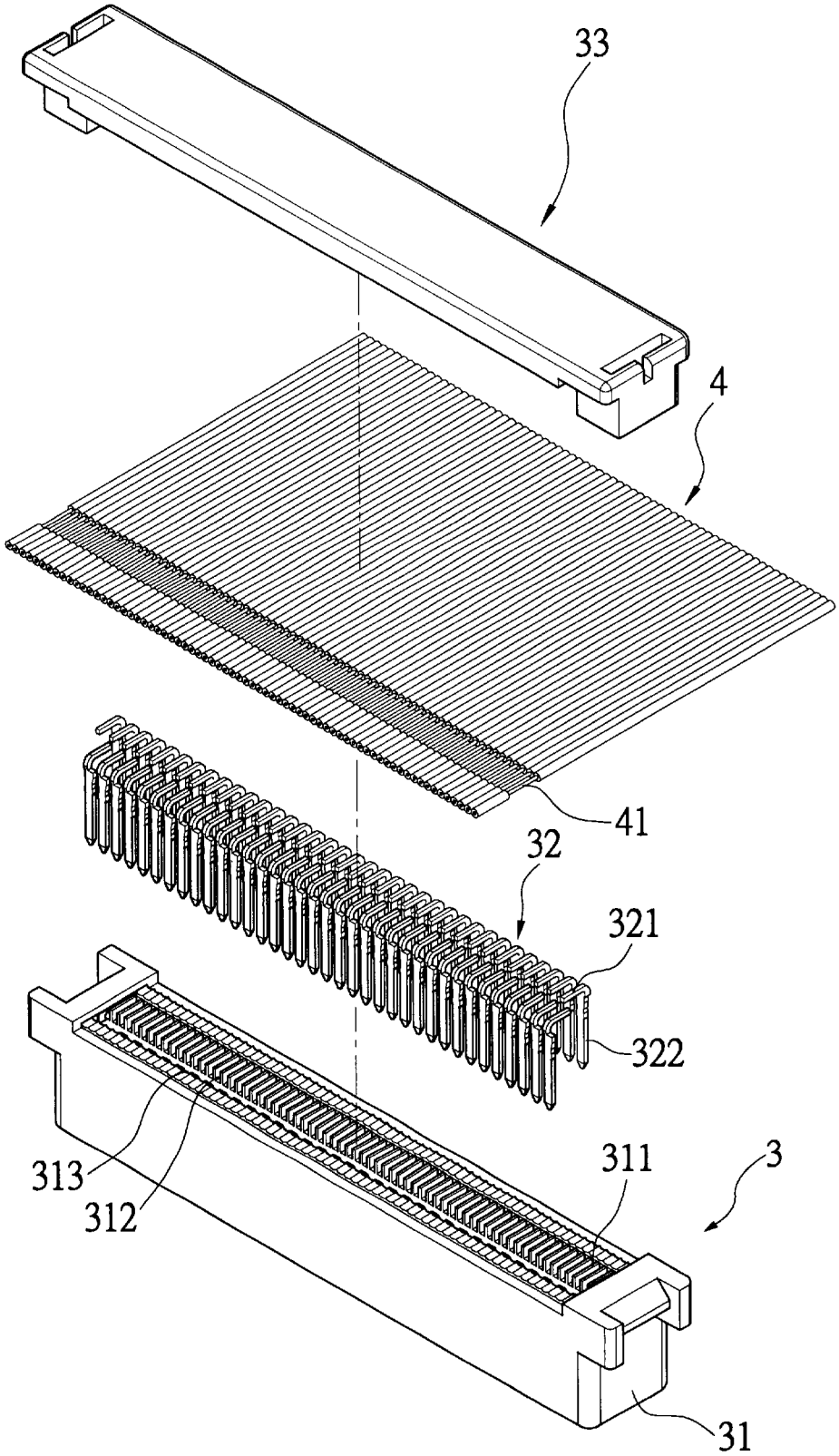
FIG. 4 is an exploded perspective view of a connector according to the present invention.

Please refer to FIG. 4 that is an exploded perspective view of a connector 3 according to the present invention. As shown, the connector 3 mainly includes an electrically insulated base 31, a plurality of electrically conductive terminals 32, and an electrically insulated cover 33. A flat cable 4 is connected to the connector 3 and fixedly held between the base 31 and the cover 33.

The electrically insulated base 31 is provided at a top with a row of spacers 311 to form a plurality of parallelly spaced slots 312. Two rows of staggered terminal holes 313 are formed on the base 31 at two longitudinal sides of the plurality of spaced slots 312, so that each terminal hole 313 corresponds to a spaced slot 312.

Figure 5:
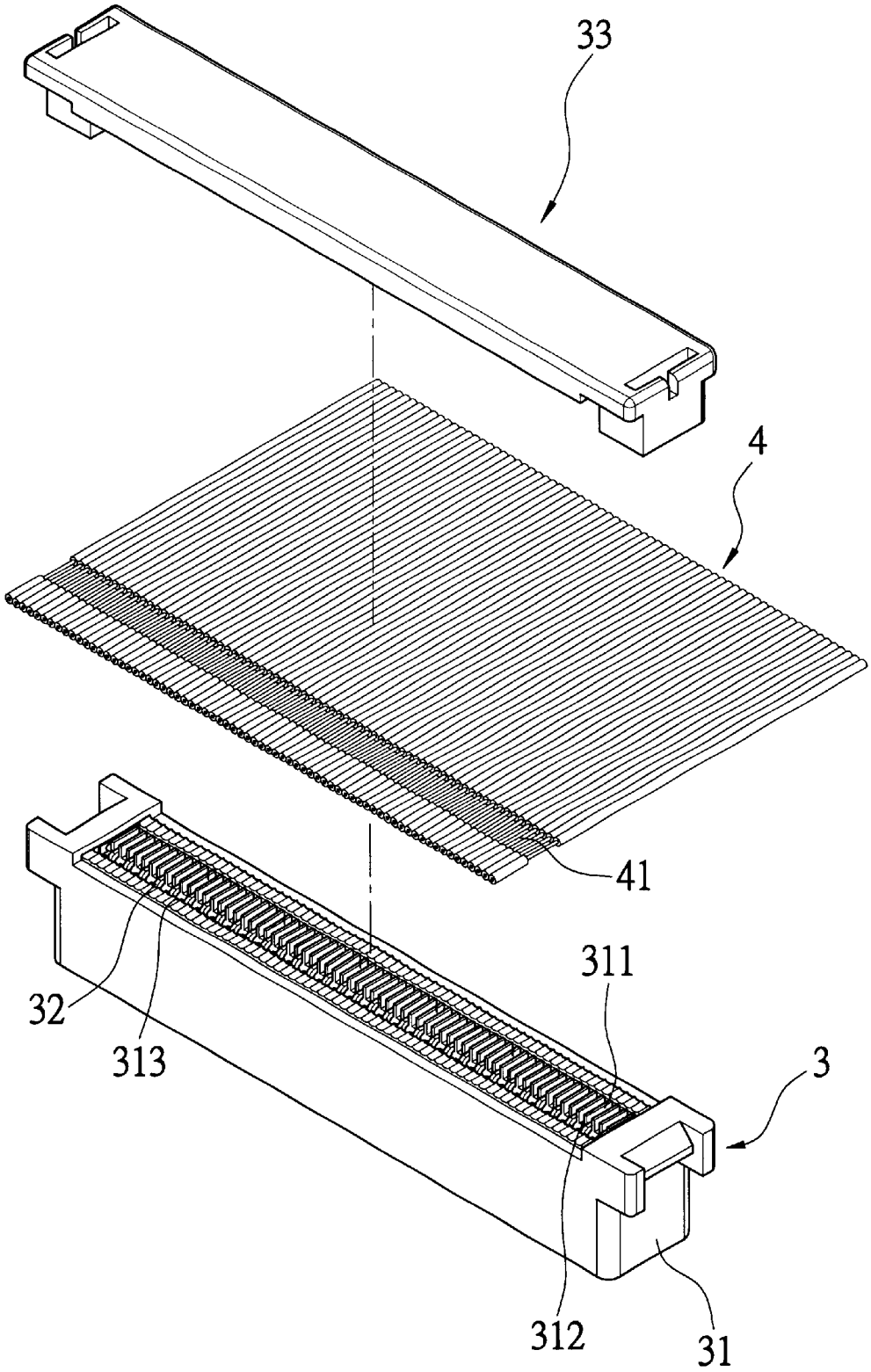
FIG. 5 is a partially assembled perspective view of the connector of FIG. 5.
Figure 7:
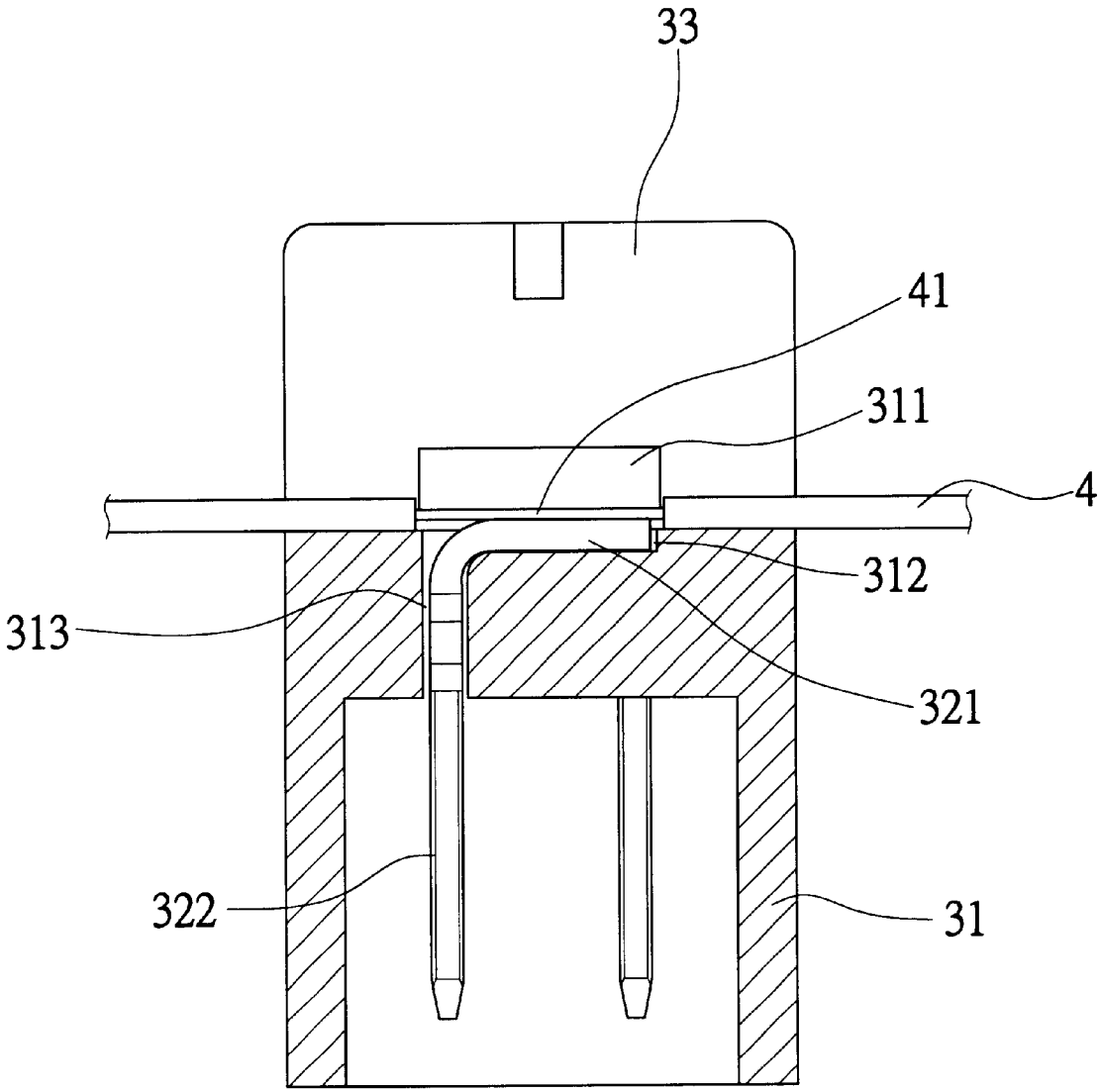
FIG. 7 is a fragmentary and enlarged sectional view of the connector of the present invention in as assembled state.

Each of the electrically conductive terminals 32 is in the shape of an inverted letter "L" to include a horizontal top serving as a contact part 321 and a vertical body serving as an insertion part 322. The contact parts 321 are sequentially seated in the spaced slots 312 on the top of the base 31 with the insertion parts 322 alternately inserted into the two rows of terminal holes 313 at two sides of the spaced slots 312, as shown in FIGS. 5 and 7.

The electrically insulated cover 33 is structured to be fitly disposed on the top of the base 31, so as to firmly hold the flat cable 4 between the base 31 and the cover 33 without the risk of a loosened flat cable 4 due to any improper pull at the flat cable 4.

Figure 6:
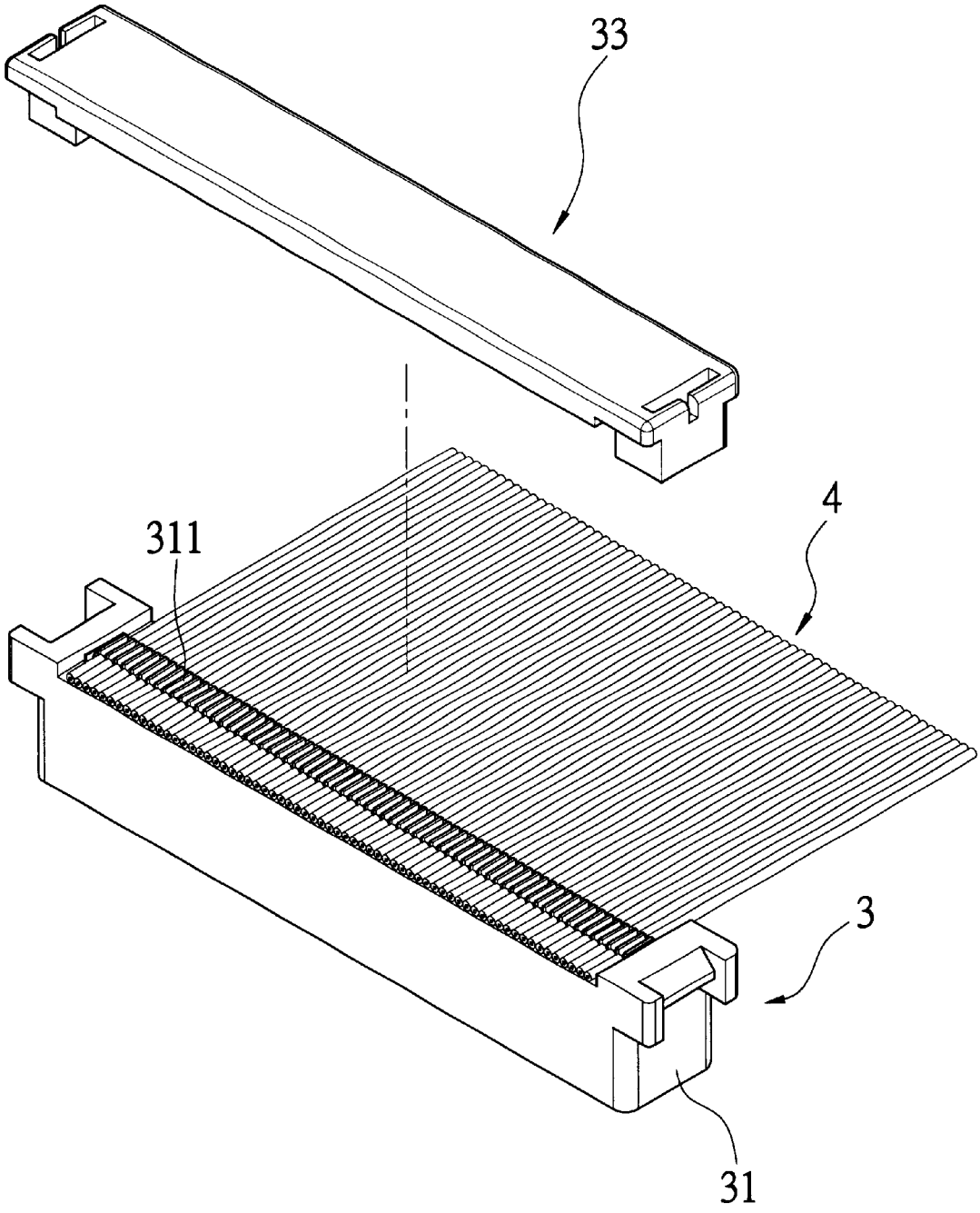
FIG. 6 is another partially assembled perspective view of the connector of FIG. 5.

The flat cable 4 is partially stripped at a small section near a front end thereof to expose a plurality of naked cores 41. The flat cable 4 is connected to the connector 3 with the naked cores 41 sequentially seated in the spaced slots 312 above and welded to the contact parts 321 of the electrically conductive terminals 32, as shown in FIGS. 6 and 7.

With the above arrangements, the spacers 311 effectively prevent any short circuit during the welding of the naked cores 41 of the flat cable 4 to the contact parts 321 of the terminals 32. Moreover, there is an increased contact area between the naked cores 41 and the contact parts 321 of the terminals 32 to enable transmission of electric signals at high speed without causing signal fluctuation.

The following are some advantages of the connector of the present invention having the above-described structure:

1. The contact parts 321 of the electrically conductive terminals 32 and the naked cores 41 of the flat cable 4 are welded together to provide increased contact areas between them. The increased contact areas enable stable signal transmission at high speed without causing signal fluctuation.

2. The spacers 311 between any two adjacent conductive terminals 32 effectively prevent the occurrence of short circuit at neighboring conductive terminals or flat cables during the welding of the naked cores 41 of the flat cable 4 to the contact parts 321 of the conductive terminals 32.

What is claimed is:

1. A connector, comprising an electrically insulated base having a plurality of electrically conductive terminals inserted through a top thereof, and an electrically insulated cover being structured to firmly hold a flat cable to said base; said connector being characterized in that said insulated base is provided at the top with a row of spacers to form a plurality of parallelly spaced slots, that said conductive terminals are separately seated in said spaced slots to be partially exposed at the top of said insulated base; and that said flat cable is stripped at a predetermined section to expose naked cores of said flat cable, and said naked cores of said flat cable are held to said insulated base by said insulated cover and are separately located in said spaced slots above said conductive terminals to electrically contact with said conductive terminals.

2. The connector as claimed in claim 1, wherein each of said electrically conductive terminals is in the shape of an inverted letter "L" to include a horizontal top that serves as a contact part and is seated in one of said spaced slots on said insulated base, and a vertical body that serves as a insertion part for inserting into said insulated base.

3. The connector as claimed in claim 2, wherein said insulated base is provided at two longitudinal sides of said one row of spacers with two rows of staggered terminal holes, so that each of said terminal holes corresponds to one of said spaced slots, and wherein said contact parts of said conductive terminals are sequentially seated in said spaced slots with said insertion parts alternately inserted into said two rows of terminal holes.

* * * * *